United States Patent [19]

Kuczynski

[11] Patent Number: 4,803,455

[45] Date of Patent: Feb. 7, 1989

[54] AUTOMATIC AND MANUALLY RESETTABLE MINIATURIZED CIRCUIT BREAKER

[76] Inventor: Robert A. Kuczynski, 520 Springfield Ave., Westfield, N.J. 07090

[21] Appl. No.: 138,562

[22] Filed: Dec. 28, 1987

[51] Int. Cl.[4] ..... H01H 71/16

[52] U.S. Cl. ..... 337/68; 337/66; 337/91

[58] Field of Search ..... 337/68, 91, 66

[56] References Cited

U.S. PATENT DOCUMENTS 4,573,031 2/1986 Krasser ..... 337/68

4,630,020 12/1986 Yang ..... 337/68

*Primary Examiner*—H. Broome

*Attorney, Agent, or Firm*—Lerner, David, Littenberg, Krumholz & Mentlik

[57] ABSTRACT

A circuit breaker having a thermally operated snap acting bimetallic actuator is miniaturized for replacing or retrofitting in place of a conventional blade or clip type fuse heretofore used for limiting current overload in a given current carrying circuit and is standardized to permit manufacture of the circuit breaker for operation in either the cycling or non-cycling mode, by providing a sized and shaped housing in which the interacting elements are so mounted and aligned that the terminals are parallel to each other and to the longitudinal line of the housing, and the bimetallic actuator is so mounted, nested, and longitudinally aligned in assembled position between the interengaging elements to provide substantial amplitude of movement of the bimetallic element and the contact thereon for coacting relation with a generally fixed contact in the cycling mode. For the non-cycling mode the housing has, a bore and slot disposed generally laterally of said interengaging elements in which bore and slot an insulating and manually reset member is slidably mounted for movement in a plane between the movable contact and the fixed contact when the contacts move from the normally closed position to open position on current overload.

19 Claims, 3 Drawing Sheets

AUTOMATIC AND MANUALLY RESETTABLE MINIATURIZED CIRCUIT BREAKER

BACKGROUND OF THE INVENTION

This invention relates generally to circuit breakers having a thermally operated snap acting bimetallic actuator and more particularly to a low cost miniature circuit breaker having, a thermally operated snap acting bimetallic actuator of the cycling or non-cycling type, for limiting the electrical overload in a given current carrying circuit and adapted for easy replacement or for retrofitting in place of the conventional blade or clip type fuses, in any given current carrying circuit.

The use in electrical circuits of a thermally operated snap acting bimetallic actuator having, a first member with a contact movable from, a normally closed contacting position with another generally stationary contact on a second member, to an open position with respect to said stationary contact for limiting the flow of current in the electrical circuit, is a known expedient in the prior art.

Such devices are shown in U.S. Pat. Nos. 2,503,008; 3,422,384; 4,068,203 and 4,379,278.

Few of these prior art devices employ the so called "Taylor Blade" bimetallic actuator as shown in U.S. Pat. No. 2,503,008 which produces its snapping action due to increasing contact pressure under changing conditions of current overload in the associated electrical system and has appreciable amplitude of movement from the closed to open position and vice versa.

The use in prior art circuit breakers of these thermally operated snap acting bimetallic actuators requires either relatively large housings which limit their application, or alternatively if smaller housings are used the reduced limited or variations in the travel of the bimetallic actuator results in reduced sensitivity and intolerance to current overload in the associated current carrying circuit and/or arcing of coacting contacts which leads to destruction and failure of the circuit breaker as a protection for the associated current carrying circuit.

The use of circuit breakers with a thermally operated snap acting bimetallic actuator for current limiting in automobiles, trucks, marine engines and related vehicular fields have been minimal due largely to the small size and terminal configuration required to use or retrofit such circuit breakers as a low cost replacement for the relatively new blade or clip type conventional fuses now used.

Some prior art devices to meet this problem provide circuit breakers having a cantilevered thermally operated bimetallic actuator. However, such cantilevered bimetallic actuators were found to be inherently unstable and erratic due to slow opening and minimal amplitude of movement of the coacting contacts which limitations on overload tend to create arcing and sticking of the coacting contacts. Further, in order to convert circuit breakers with such cantilevered type bimetallic actuators from cycling type operation to the non-cycling type operation, a heater wire is added or incorporated to provide an auxiliary source of heat to prevent the bimetallic element of the bimetallic actuator from cooling too rapidly, thus permitting the coacting contacts of the bimetallic actuator to remain open for a longer period of time to in turn prevent the circuit breaker from moving to the normally closed position.

Additionally, circuit breakers having cantilevered type bimetallic actuators which are of the cycling type have bimetallic sensing elements which by necessity, due to the purpose and function of the circuit breaker, are relatively heavy and thick. Such sensing elements during a malfunction such as a short circuit, do not provide the fail safe condition which is desirable when an electrical overload occurs in the circuit. An obviously dangerous condition. In those circuit breakers with a cantilevered type bimetallic actuator which have an auxiliary heating wire to provide a non-cycling type of operation, should the heating wire fail due to a poor weld or other conditions, the circuit breaker will revert to a cycling type of operation and the same dangerous condition on direct short circuit or high overload conditions is then created once again.

Most of these prior art circuit breakers, such as the circuit breakers with cantilevered type bimetallic actuators, have no visual indication of an overload condition nor coacting manual means for resetting the circuit breaker when the overload condition has occurred.

In U.S. Pat. No. 4,379,278, a circuit breaker is shown having a "Taylor Type" thermally operated snap acting bimetallic actuator. In operation, the bimetallic element on the "Taylor Type" bimetallic actuator due to increasing contact pressure during an increase in current will under adverse conditions in the current carrying circuit, at the calibrated trip or snap to open point, move the coacting contacts from the normally closed position to an open position with the appreciable amplitude characteristic of the "Taylor Type" bimetallic actuators.

If the device as shown in U.S. Pat. No. 4,379,278 were permitted to operate in the cycling mode, it would be subject to the same short circuiting problems as other prior art circuit breakers. To prevent this dangerous condition from occurring between the coacting contacts, this patent discloses an insulating and reset device which on opening movement of the contacts slides between the coacting contacts, and remains in this position until it is manually reset after the cause of the overload condition is corrected in the associated current carrying circuit being protected by the circuit breaker.

In this U.S. Pat. No. '278 a relatively small circuit breaker having high stability, smooth and accurate operation within the desired calibration for operation, and close tolerance during manufacture was achieved by having staggered terminals and by mounting the bimetallic actuator transversely therebetween so that the insulating and reset device and its actuating spring can be disposed coaxially to each other in the center line of the circuit breaker to insure the desired smooth operation both under adverse conditions in the circuit and on reset to place the circuit breaker back into operation in the associated current carrying circuit.

However, the circuit breaker disclosed does not provide sufficient room for the coacting elements to enable it to be miniaturized to the dimensions required for replacement or for retrofitting this device in place of a conventional blade or clip type fuses used to prevent overloads in an associated current, carrying circuit.

The present invention provides an improved circuit breaker utilizing a "Taylor Type" thermally operated snap acting bimetallic actuator which is standardized to operate in a cycling mode or may be converted very simply to a non-cycling mode by adding an insulating and reset slide or member disposed to move between the coacting contact elements of the bimetallic actuator when the contacts are moved from the normally closed position to the open position. In this improved circuit breaker the elements are so arranged that the size of the circuit breaker can be reduced and miniaturized to enable this circuit breaker to replace or to be retrofitted in place of the conventional blade or clip type fuses for limiting current overload in an associated current carrying circuit.

In the present invention in order to achieve this desirable end and to provide a circuit breaker capable of being manufactured and assembled for either the cycling mode or the non-cycling mode, the terminals and the bimetallic actuator are disposed in the limited space available in the housing for the circuit breaker in alignment with each other and parallel to the longitudinal line of the housing, the housing also having sufficient room to provide means, in the case of a non-cycling circuit breaker for adding or assembling an insulating and reset slide or member in a position offset from and overlapping at least one of the aligned terminals to permit movement parallel to the same longitudinal line of the housing for the circuit breaker so that the insulating and reset assembly can provide the same advantageous operation as is achieved in U.S. Pat. No. '278.

SUMMARY AND OBJECTS OF THE INVENTION

Thus, the present invention covers an improved miniature circuit breaker for use in limiting the overload in a current carrying circuit including, a sized housing having, a front wall, a back wall, oppositely disposed side walls which hold the front and back wall in predetermined spaced relation to each other, and an end wall which define an element chamber open at one end, a closure means is connected to the housing to seal the open end of the element chamber, said back wall is provided with mounting guides on the element chamber surface disposed parallel to each other and in alignment with the longitudinal line of the housing, said end wall having spaced and aligned slot means such that each slot is disposed in alignment with an associated one of said spaced mounting guides, a first sized generally elongated planar member fixedly mounted in one of the said spaced mounting guides and disposed to extend through a first associated slot means in the end wall to the exterior of the circuit breaker forms a first terminal, a second sized generally elongated planar member fixedly mounted in another of the spaced mounting guides and also disposed to extend through a second associated slot means in the end wall to the exterior of the circuit breaker forms a second terminal spaced from said first terminal, said first elongated member having a bimetallic actuator so mounted thereon that the bimetallic actuator is parallel to the longitudinal line of the housing, said bimetallic actuator having a temperature responsive bimetallic element with a first contact mean thereon disposed in assembled position so that the bimetallic element and first contact means lie in the medial section of the chamber to permit maximum amplitude of movement during operation of the bimetallic actuator, said second elongated planar member having a second contact thereon to coact with the movable contact on the bimetallic actuator, and said first contact and said second contact disposed normally in the engaged or closed position and to disengage from each other and move to the open position when an overload occurs in the current carrying circuit.

Further, the present invention covers an improved circuit breaker as above described wherein, the housing means defines a mounting bore offset from at least one of elongated planar member, an insulating and reset slide is mounted in said mounting bore for sliding movement parallel to the longitudinal line of said housing, resilient means operatively connected to the insulating and reset slide, said insulating and reset slide normally disposed out of engagement with said first contact and second contact and movable by said resilient means into a position between said coacting first contact and second contact when the first contact is snapped to open position with respect to said second contact, and said insulating and reset assembly having, visual signal and manual reset means disposed to extend to the exterior of the housing on movement thereof by said resilient means to provide means for resetting said insulating and reset slide to the normal non-engaged position.

Accordingly, it is an object of the present invention to provide a relatively low cost miniature circuit breaker having a terminal configuration to permit direct replacement for conventional fuses of the blade or clip type for limiting overload in a current carrying circuit more particularly for current carrying circuits in automotive, truck and other vehicles.

It is another object of the present invention to provide a low cost miniature circuit breaker to replace or adapted in place of a conventional fuse of the to be retrofitted in place of a conventional fuse of the blade or clip type in a current carrying circuit utilizing a single housing, for operation of the circuit breaker in the cycling mode, or non-cycling mode. In the non-cycling mode it also provides a visual signal on overload conditions in the associated current carrying circuit and manual reset means for resetting the circuit breaker.

It is another object of the present invention to provide an improved relatively low cost miniature circuit breaker for use in an associated current carrying circuit to limit the current overload therein which does not sacrifice sensitivity, stability, and endurance under overload conditions during operation.

It is another object of the present invention to provide an improved low cost miniature circuit breaker having, a housing and a thermally operated snap acting bimetallic actuator with a bimetallic element therein to snap the coacting contacts to open position so as to prevent contact deterioration at least in part by the amplitude of movement permissible in the housing for the circuit breaker.

It is another object of the present invention to provide an improved low cost miniature circuit breaker utilizing a bimetallic actuator designed for high quality manufacture and assembly which is capable of operating as a cycling self resetting device or as a non-cycling manual resetting device by exclusion of or the addition of an insulating and reset slide or member therein.

It is a still further object of the present invention to provide an improved low cost miniature non-cycling circuit breaker utilizing a thermally operated snap acting bimetallic actuator having, a spring operated insulating and reset assembly to maintain the open circuit condition in the associated current carrying circuit, to provide a visual signal when an overload condition occurs, and to provide a means to manually reset the circuit breaker.

It is still another further object of the present invention to provide an improved low cost miniature circuit breaker in which the insulating and reset side is capable of carrying and aligning the spring means for operating the same and the insulating and reset slide is formed by stamping the same out of an electrically inert insulating material; thus eliminating the need and problems associated with the molding of these elements such as warping, gates, flashing, etc.; which can cause malfunction in the movement and travel of the insulating and reset slide during operation under overload conditions in the associated current carrying circuit protected by the circuit breaker.

It is still another object of the present invention to provide a low cost miniature circuit breaker which provides a construction for the repetitive location of each of the operative elements with respect to each other, and It is a still further object of the present invention to provide a low cost miniature circuit breaker capable of assembling and loading all the operatively associated elements from one end to permit easier, faster and uniform repetitive assembly of such elements, thus adapting miniature circuit breaker without the necessity of revolving the housing or elements during assembly, for automated insertion and assembly of the operatively associated elements thus minimizing the cost of fabrication of the circuit breaker.

These and other objects will become clear from the description and Claims of the preferred embodiment which follows when the same are taken with the drawings in which:

DESCRIPTION OF A PREFERRED EMBODIMENT

Figure 1:
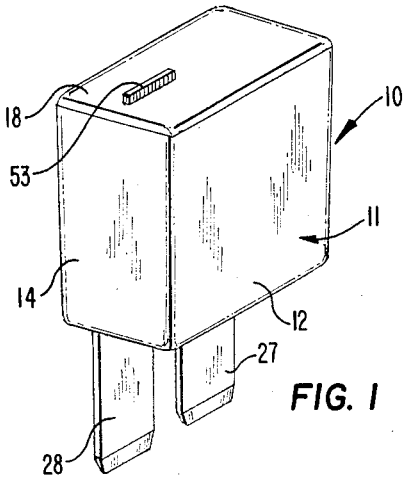
FIG. 1 is a perspective view of a miniature circuit breaker with manual reset in accordance with the present invention.
Figure 2:
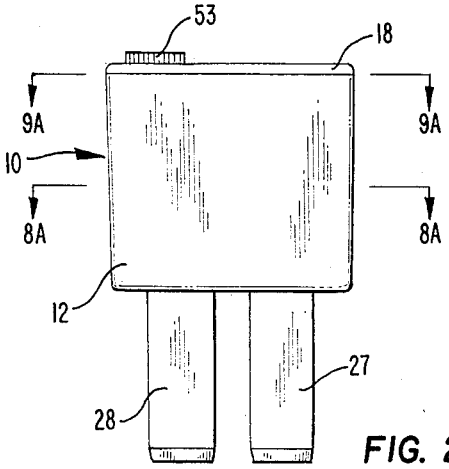
FIG. 2 is a front view of the miniature circuit breaker with manual reset shown in FIG. 1.
Figure 3:
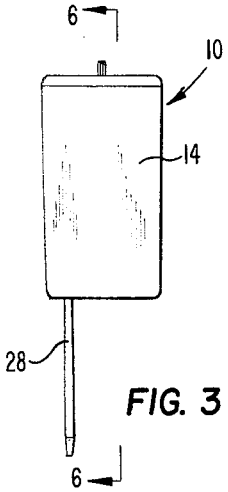
FIG. 3 is a side view of the miniature circuit breaker with manual reset shown in FIG. 1.
Figure 4:
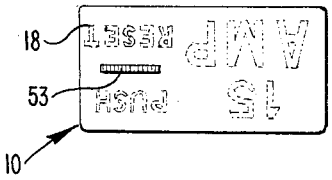
FIG. 4 is a top plan view of the miniature circuit breaker with manual reset shown in FIG. 1.
Figure 5:
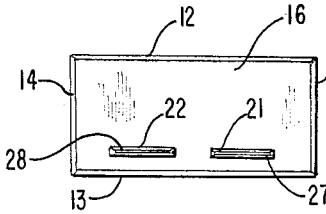
FIG. 5 is a bottom plan view of the miniature circuit breaker with manual reset shown in FIG. 1.

Referring to the drawings FIGS. 1 to 11 show one preferred form of a non-recycling circuit breaker generally designated 10 in accordance with the present invention.

Circuit breaker 10 has a thermally operated snap acting bimetallic actuator of the "Taylor Type" generally designated 30 and an insulating and reset assembly generally designated 50.

Those skilled in the art will come to recognize from the description which follows below that while the drawings illustrate a circuit breaker operable in the non-cycling mode that the illustrated circuit breaker can be easily converted into a cycling type circuit breaker by simply removing or not adding during assembly of the circuit breaker the insulating and reset assembly 50.

Thus, circuit breaker 10 is shown as having a generally rectilinear housing 11 having, a first or front wall 12, a second or back wall 13, sized oppositely spaced side walls 14 and 15 which are connected so as to hold the front wall 12 and back wall 13 in predetermined spaced and aligned relationship, and a bottom or end wall 16 which define an element space or chamber 17 closed at one end and open at the opposite end. A closure member 18 is connected to the open end of the housing after assembly of the elements of the circuit breaker into the element chamber 17 to effectively seal the elements of the circuit breaker therein.

The housing 11 is molded or formed from any suitable type of plastic material adapted to meet the physical and operating requirements for circuit breakers for the uses and purposes as set forth herein.

It will be apparent to those skilled in the art that the generally unitary form of the housing as above described having a single end opening will require that the operatively associated elements of the miniature circuit breaker in accordance with the present invention must be loaded or assembled through the single end opening. The operatively associated elements as will be clear from the description hereinafter set forth are formed to permit assembly through the single end opening thus adapting the miniature circuit breaker, in accordance with the present invention, for automated insertion during assembly and fabrication of the miniature circuit breaker in accordance with the present invention.

FIGS. 8A, 8B, 9A, 9B, 10A and 10B show that the inner surface of the back wall 13 is formed to provide spaced longitudinal mounting guides or grooves 19 and 20 disposed respectively parallel to the longitudinal line of the housing 11 of the circuit breaker 10. Slots 21 and 22 extending through the bottom wall 16 are positioned in alignment respectively with the mounting guides 19 and 20. The slots are narrower in width than mounting guides so that the bottom wall 16 forms at least one stop 23 adjacent the associated mounting guide 19 and similarly at least one stop 24 adjacent the mounting guide 20.

Elongated generally planar members 25 and 26 are mounted in the respective mounting guides or grooves 19 and 20 so that a portion of each of said planar members extends through the associated slots 21 and 22 in the bottom wall 16 to the exterior of the housing 11 to form a first terminal 27 and a second terminal 28 for connecting the circuit breaker into any suitable type of conventional receptacle, not shown, in the associated current carrying circuit, also not shown, being protected against current overload by the circuit breaker.

The elongated generally planar member 25 is shaped to provide a first shoulder 29 at an intermediate point thereon such that in assembled position in the associated mounting guide 19, first shoulder 29 will engage the stop 23 on the bottom wall 16 to fix the planar member 25 in assembled position and also control the length of the first terminal 27. Similarly the planar member 26 will have a second shoulder 40 formed thereon that in assembled position in mounting gu 20, engages the stop 24 on the bottom wall 16 to fix the planar member 26 in assembled position and to control the length of the second terminal 28.

Medially along the front face of that portion of the elongated planar member 25 disposed in assembled position in the mounting guide 19, a bimetallic actuator bracket 31 is formed. Bimetallic actuator 30 which is used in the circuit breaker 10 in accordance with the present invention is so connected to the bimetallic actuator bracket 31 that it can advantageously use the large amplitude of movement characteristic a "Taylor Type" unit. Thus, the bimetallic actuator includes, an annular section 32, and a bimetallic element 33 connected at one end in the central line of the annular section 32 and having a contact 34 connected to the free end of the bimetallic element. The annular section 32 at the point remote from the point of connection of the bimetallic element 33 is indented as at 35 and the indent 35 is sized so that it can be welded to the outer or front face of the bracket 31, as is shown in FIGS. 8A, 8B, 9A, 9B and 11 of the drawings. This assembly so positions the free end of the bimetallic element 33 that the contact 34 thereon is in a plane forward of t outer face of the indent 35 on the bimetallic actuator 30.

Those skilled in the art will readily recognize that the contact 34 when moved by the conventional operation of the bimetallic element 33 will, because of the positioning of the bimetallic element, have substantial amplitude of movement for the desired operation of the circuit breaker in accordance with the present invention as is more fully described below.

Coacting with the movable contact 34 is a stationary contact 36 which is connected to a stationary contact bracket 37 formed medially along the front face of the portion of the elongated planar member 26 disposed in the mounting guide 20.

When the elongated planar member 28 is formed or stamped, the stationary contact bracket 37 has a curved section **37*a* projected normal to the main section of the planar member 26, and a flat section 37*b* which extends laterally in a plane normal to the curved section 37*a* and parallel to and spaced a predetermined distance from the main section of the planar member 26 so that in assembled position the flat section 37*b* will overlie the movable contact 34 on the bimetallic element 33. A contact 36 affixed to the side of the flat section 37*b* adjacent to the movable contact 34 coacts with the movable contact 34 of the bimetallic element 33** of the bimetallic actuator.

Additionally, a support strut and guide 38 is formed at the uppermost end of the curved section **37*a* and during assembly will engage with an aligning guide or groove 39 formed on the inner face of the front wall 12, all of which is shown in FIGS. 8A, 8B, 9A, 9B, 1OA and 11**.

Thus, in assembled position the coacting movable contact 34 and stationary contact 36 are in alignment for proper contacting engagement and for disengagement during operation of the circuit breaker 10.

Bimetallic element 33, as is well known in the bimetallic actuator art, operates as a function of the temperature of the current flowing through the current carrying circuit in which the bimetallic actuator is connected to limit current overload. When an overload condition occurs as the temperature of the current increases, the temperature of the bimetallic element increases. However, the bimetallic element is so calibrated that within a given range of temperature the bimetallic element will snap the contact 34 out of engagement with contact 36 and thus open and terminate the flow of current in the current carrying circuit being protected.

Where the circuit breaker is assembled so that the bimetallic actuator operates in the cycling mode, the circuit breaker will return or reset itself in the engaged or contacting position when the bimetallic element of the bimetallic actuator cools below the snap acting range whether the cause of the overload in the associated current carrying circuit has been corrected or not. This is a dangerous condition because the current carrying circuit can then go back into operation and the same type of burn out may result as would occur if the current carrying circuit was being protected by a conventional fuse.

The present invention meets this problem by providing an improved insulating and reset assembly 50 constructed and arranged in the housing 11 for coaction with the bimetallic actuator 30 so that a non-cycling miniaturized, manually resettable circuit breaker can be manufactured and assembled with the characteristics of size, stability, and the tolerances which adapts it to replace or to be retrofitted in place of a conventional fuse of the blade or clip type in a current carrying circuit to be protected.

INSULATING AND RESET ASSEMBLY

Thus, by reference to FIGS. 6, 7, 8A, 8B, 9A, 9B, 1OA, 10B and 11, housing 11 is shown as having an elongated bore 47 extending a predetermined distance into the side section as at 41 so that bore 42 extends parallel to the longitudinal line of the housing 11 and the respective mounting guides 19 and 20.

The bore 42 does not extend end to end through the housing but has a blind inner end that forms a stop surface 43 inwardly of the closed end of the housing. The opposite end is open as at 44 adjacent the top or open end of the housing 11. Bore 42 is so formed in the housing that it lies forward of and in overlapping relation to mounting guide 20 and the elongated planar member 26 when this element is in assembled position in the mounting guide, all of which is shown in FIGS. **8*a*, 8B, 9A, 9B, 1OA and 11** of the drawings.

Figure 9A:
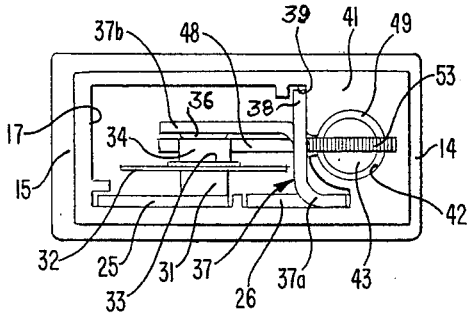
FIG. 9A is a top plan view taken on line 9A—A of FIG. 2 with the top closure removed and showing the insulating and reset member in the non-engaged with respect to the coacting contacts for the circuit breaker shown in FIG. 1 to 7 of the drawings.
Figure 9B:
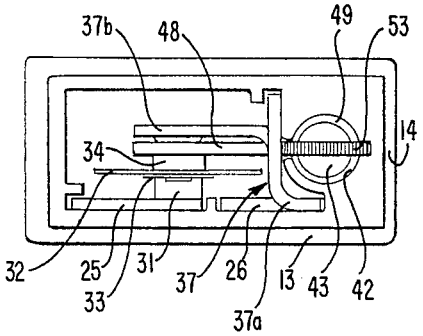
FIG. 9B is the same top plan view as FIG. 9A showing the insulating and reset slide moved to the engaged position between the coacting contacts for the circuit breaker shown in FIGS. 1 to 7 of the drawings.
Figure 10A:
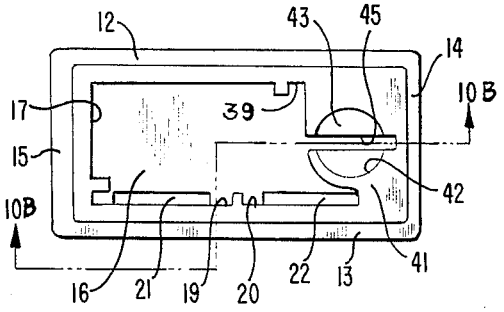
FIG. 10A is the same top plan view as FIG. 9A of the housing with the top closure removed with all the elements removed from the element chamber in the housing.
Figure 10B:
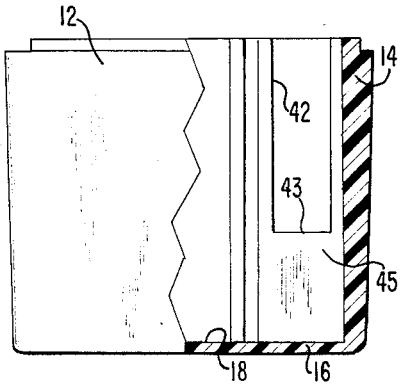
FIG. 10B is a partial vertical section taken on line FIG. 10B—10B of FIG. 10A.
Figure 11:
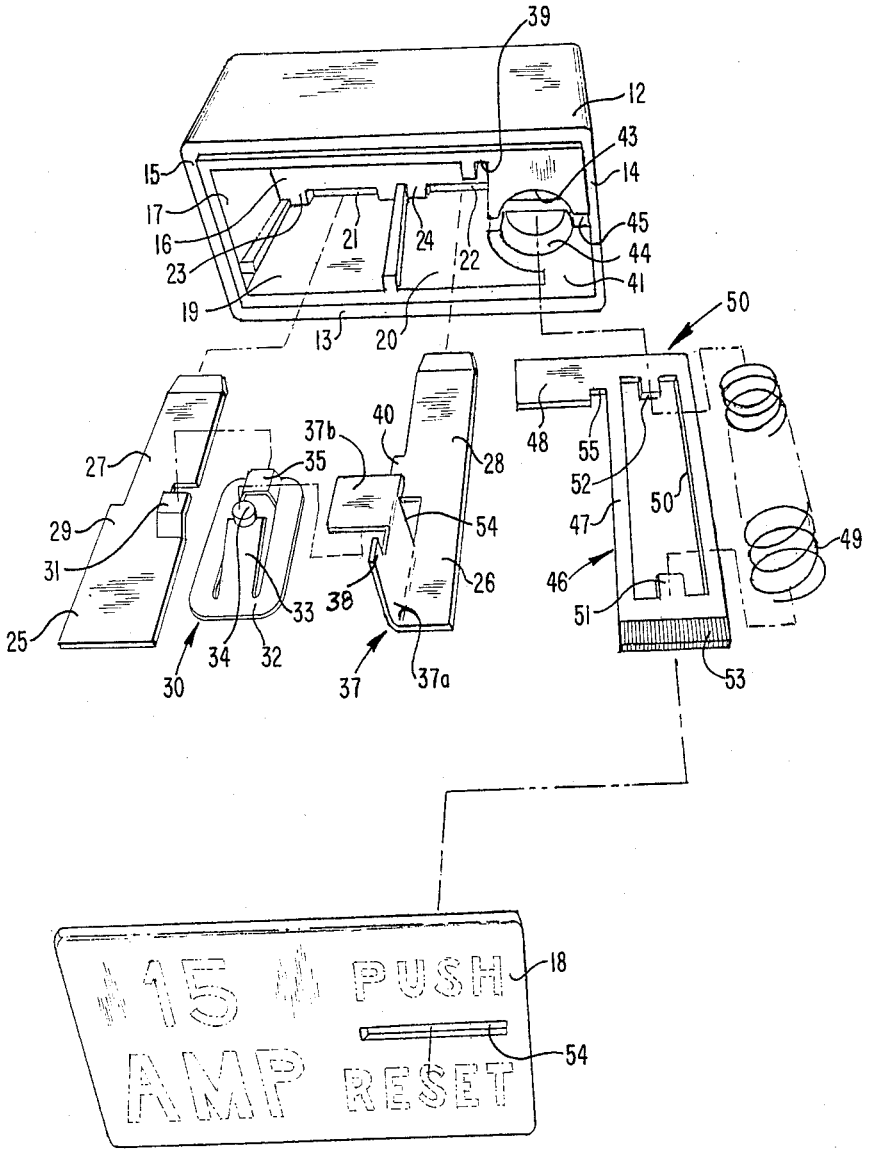
FIG. 11 is an exploded view showing the operatively associated elements of the miniature circuit breaker with manual reset as shown in FIGS. 1 to 1OB of the drawings.

Further, FIGS. 9A and 9B show that when the elongated planar member 26 is in assembled position in mounting guide 20, the curved section 37*a* of the stationary contact bracket 37 fits conveniently about the overlapping solid section 41 so that the support strut and guide 38 will align and engage with the aligning guide or groove 39 on the inner wall of front wall 12 of the housing 11.

FIGS. 8A, 8B, 9A, 9B, 1OA and 11 also show that an elongated slot 45 slightly larger in width than the diameter of the bore 42 is also formed in the solid section 41 so that it extends along the longitudinal centerline of the bore 42. Elongated slot 45 has a thickness such that an insulating and manual reset slide 46 can be slideably mounted in the elongated bore 45. In assembled position, as will now be described, the insulating and manual reset slide 46 will coact with the bimetallic actuator 30.

The insulating and reset member 46 is generally L-shaped in front elevation and is formed or struck as a generally unitary member from any suitable type of plastic such as a phenolic, a coated cardboard, or any electrically inert insulating flat bar stock material which has the dielectric characteristics and strength for the required purpose and function when in assembled position and operation in the circuit breaker. Insulating and reset slide 46 has a first sized and elongated leg 47 and a sized second leg 48 which is generally transverse to the longitudinal line of the first leg 47. The insulating and reset member 46 will be so assembled that the first leg 47 will be slideably disposed in the elongated slot 45 and the second leg 48 will extend transversely into the element chamber 17, the slot 45 being so cut that the transverse second leg 48 will move in a plane which lies between the coacting movable contact 34 and fixed contact 36 when these contacts move to the disengaged or open position.

The L-shaped insulating and reset slide or member 46 is actuated by a helical spring 49 which is mounted in a generally rectangular cut out 50 having spaced projections as at 51 and 52 at the opposite ends thereof to retain, hold and align the spring 49 when it is assembled in the cut out 50.

The insulating and rest member 46 with the helical spring 49 assembled therein is slideably mounted through the open end of the elongated slot 45 and the bore 42 because they are sized to receive these elements.

Figure 7:
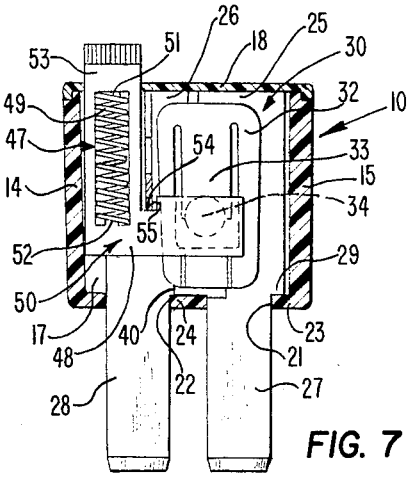
FIG. 7 is the same vertical cross-section as FIG. 6 showing the insulating and manual reset slide moved to the engaged position between the coating contacts, with the spring means expanded and the visual and manual reset section of the insulating and manual reset slide extending to the exterior of the housing.
Figure 8A:
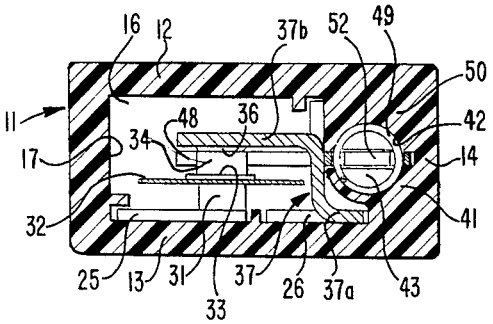
FIG. 8A is a horizontal cross-section taken on line 8A—8A of FIG. 2 with the insulating and manual reset slide in the non-engaged position with respect to the coacting contact for the circuit breaker shown in FIGS. 1 to 7 of the drawings.
Figure 8B:
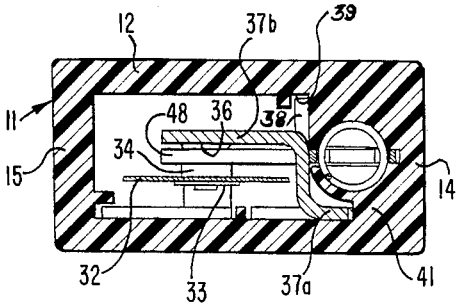
FIG. 8B is the same horizontal cross-section as FIG. 8A showing the insulating and reset slide moved to the engaged position between the coating contacts for the circuit breaker shown in FIGS. 1 to 7 of the drawings.

During assembly of the elements in the element chamber 17 the first elongated planar member 25 will be mounted in the mounting guide 19 so that the bimetallic actuator 30 will be disposed in the central portion of the element chamber 17 to permit the bimetallic element 34 to move freely in accordance with the substantial amplitude that can be obtained with a "Taylor Type" bimetallic actuator. The insulating and reset slide 46 is then slideably mounted in the bore 42 and sized slot 45 until the lower end of the helical spring 49 engages and is stopped by the stop surface 43 formed by the blind end of the bore 42. In this position the transverse leg 48 of the insulating and reset member 46 will overlie the contact 34 on the end bimetallic element 33, as is shown by FIG. 7 of the drawings.

In this initial position of assembly the sized longitudinal or vertical leg 47 of the insulating and reset member 46 will extend a substantial distance above the closure end of the housing 11 to provide a visual signal and manual reset section 53 that will extend through the reset slot 54 in the closure 18 when the closure 18 is connected to the open end of the housing 11 to seal the coacting elements of the circuit breaker 10 in the element chamber 18.

Reference to FIGS. 8A, 8B, 9B and 11 will show that the second elongated planar member 2 can now be set into position in mounting guide 20 so that curved section 37*a* of the stationary contact bracket 37 extends about the solid section 41 and the support strut 38 fits into a support guide 39 on the inner face of the front wall 12. The lower end of the stationary contact bracket 38 forms a stop shoulder 54 which is engaged by a groove 55 in the upper edge of the transverse leg 48 to limit the upward movement of the insulating and reset member 46 during operation of the circuit breaker 10 during overload conditions in the current carrying circuit being protected.

When the elements of the circuit breaker 11 are assembled in the element chamber 17 as above described, the closure 18 can be positioned so that the visual and manual reset section 53 of the insulating and reset member 46 extends through the reset slot 54 and the closure 18 can then be connected to the open end of the housing 11 by any suitable means to seal the elements in assembled position in the housing 11.

OPERATION

In order to prepare the circuit breaker for operation when it is assembled in the current carrying circuit, not shown, and assuming that the current is below the trip point for the bimetallic actuator in the circuit breaker the contacts 34 and 36 will be in engagement and closed, and the visual and manual reset section 53 of the insulating and reset member 46 is not visible.

Figure 6:
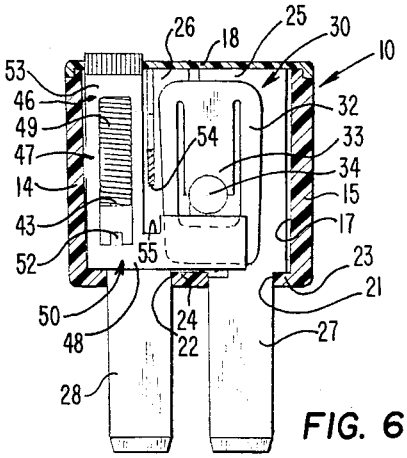
FIG. 6 is a vertical cross-section taken on line 6—6 of FIG. 3 showing the insulating and manual reset slide in the disengaged or non-engaged position with respect to the movable coacting contact on the bimetallic actuator for the circuit breaker shown in FIGS. 1 to 5 of the drawings.

In this position, as shown in FIG. 6, the helical spring 43 is compressed and the transverse leg 48 of the insulating and reset member 46 is held from upward movement by the engaged contacts 34 and 36, as is shown in FIG. 6 of the drawings.

The circuit breaker 10 is now placed in the receptacle, not shown, in the current carrying circuit, also not shown, where it remains passive as long as a current overload does not occur in the current carrying circuit. However, when such current overload does occur, the bimetallic element 33 and the contact 34 disengage and snap to an open position with respect to the fixed contact 36.

Since, the insulating and reset slide 46 is freely mounted, helical spring 49 expands and forces the insulating and reset member 46 upward so that the transverse leg 48 moves into the plane between the contacts 34 and until the stop groove 55 on the transverse leg engages the upper stop 54 on the contact bracket 37 formed on the planar member 25. The upper limit of movement will position the transverse leg 49 exactly between the contacts 34 and 36 and prevent the contacts from moving to a closed position. The insulating and manual reset slide 46 thereafter can be manually depressed to permit contacts 34 and 36 to again engage each other.

Further, when the insulating and reset slide 46 moves upward, the visual and manual reset section 53 on the longitudinal or vertical leg 47 of the insulating and reset slide 46 will extend a substantial amount above the upper surface of the closure 18. If the reset section 53 is marked with a contrasting color it will immediately be clear that an overload condition has occurred in the associate current carrying circuit being protected. Thus, the cause of the overload can be checked and corrected. Then by manually depressing the reset section 53 the insulating and reset slide 46 can again be positioned so that the contacts 34 and 36 can engage each other to permit current to again flow in the associated current carrying circuit.

This action and resetting of the insulating and reset slide 46 can be repeated as many times as may be necessary to protect the associated current carrying circuit.

Thus, a relatively simple miniaturized circuit breaker with a clearly visible signal and manually resettable assembly has been described which is standardized to also provide an automatic reset circuit breaker adapted in either form to meet the space requirements for the replacement or retrofitting in place of a standard or conventional fuse of the blade or clip type, to protect a current carrying circuit.

In the manual reset form of the present invention false reset under vibration or other conditions is prevented such as might occur under extremely cold weather conditions, because the insulating and reset member is physically disposed between the coacting contacts of the bimetallic actuator and maintains them separated until it is manually reset when the cause of the current overload is corrected in the current carrying circuit.

While one preferred embodiment of the invention has been described such description is only be way of illustration and not of limitation to the scope thereof as set forth in the following claims.

What is claimed is:

1. A miniature circuit breaker comprising, a. sized housing means having, wall means including, a back wall, a front wall, spaced side walls therebetween, and an end wall defining an element chamber, b. spaced mounting guides on the element chamber surface of the back wall disposed parallel to the longitudinal line of the housing, c. spaced slot means in the end wall respectively disposed in alignment with an associated one of said spaced mounting guides, d. first elongated current carrying means disposed in one of said spaced mounting guides and having a portion thereof extending through one of the aligned slot means to form a first terminal means, e. second elongated current carrying means disposed in another of said spaced mounting guides also having a portion thereof extending through another of said aligned slot means to form a second terminal means aligned with and parallel to said first terminal means, f. first contact means in said element chamber fixedly connected to said first elongated current carrying means, g. bimetallic actuating means in said element chamber connected to said second elongated current carrying means having, a bimetallic element disposed in alignment with the second elongated current carrying means, h. second contact means on said bimetallic element movable for engagement and disengagement with the first contact means as a function of the operation of said bimetallic element, and i. said first elongated current carrying means, said second elongated current carrying means, and said bimetallic actuator so mounted, assembled and nested in the housing that the bimetallic element is free for substantial amplitude of movement to permit operation of the circuit breaker in the cycling mode.

2. In a miniature circuit breaker as claimed in claim 1 wherein, a centrally disposed ridge on the element chamber side of the back wall, a coacting ridge on one of the side walls, and means on the other side wall define the spaced mounting guides on the element chamber surface of the back wall.

3. In a miniature circuit breaker as claimed in claim 1 wherein, a. the spaced slot means are each respectively of a lesser width than the width of the associated mounting guides, b. spaced stop means formed on the end wall adjacent each of said spaced slot means, c. said first elongated current carrying means having a first shoulder means disposed to engage one of said stop means in assembled position, and d. said second elongated current carrying means having a second shoulder means disposed to engage another of said stop means in assembled position.

4. In the miniature circuit breaker as claimed in claim 1 wherein, a. said bimetallic element includes, an annular base means connected to the carrying means, and a bimetallic member connected at one end to the annular base means so that the free end is in the longitudinal line of the second elongated current carrying means and can move responsive to changes in temperature, b. said second contact means connected to and movable with the free end of said bimetallic member, c. bracket means connected to said first current carrying means having a portion thereof disposed to overlie the second contact means, and d. said first contact means fixedly connected to the side of the bracket means for operative association with the second contact means.

5. In a miniature circuit breaker as claimed in claim 1 wherein, a. a centrally disposed ridge on the element chamber side of the back wall, a coacting ridge on one of the side walls, and means on the other side wall, define the spaced mounting guides on the element chamber surface side of the back wall, b. the spaced slot means are each respectively of a lesser width than the width of the associated mounting guides, c. spaced stop means formed on the end wall adjacent each of said spaced slot means, d. said carrying means having a first shoulder means disposed to engage one of said stop means in assembled position, and e. said second elongated current carrying means having a second shoulder means disposed to engage another of said stop means in assembled position.

6. In a miniature circuit breaker as claimed in claim 1 wherein, a. a centrally disposed ridge on the element chamber side of the back wall, a coacting ridge on one of the side walls, and means on the other side wall, define the spaced mounting guides on the element chamber surface side of the back wall, b. said bimetallic element includes, an annular base means connected to the second elongated current carrying means, and a bimetallic member connected at one end to the annular base means so the free end is in the longitudinal line of the second elongated current carrying means and can move responsive to changes in temperature, c. said second contact means connected to and movable with the free end of said bimetallic member,
d. bracket means connected to said first current carrying means having a portion thereof disposed to overlie the second contact means, and
e. said first contact means fixedly connected to the side of the bracket means for operative association with the second contact means.

7. A miniature circuit breaker comprising,
a. sized housing means having, wall means including, a back wall, a front wall, spaced side walls therebetween, and an end wall defining an element chamber,
b. spaced mounting guides on the element chamber surface of the back wall disposed parallel to the longitudinal line of the housing,
c. spaced slot means in the end wall respectively disposed in alignment with an associated one of said spaced mounting guides,
d. first elongated current carrying means disposed in one of said spaced mounting guides and having a portion thereof extending through one of the aligned slot means to form a first terminal means,
e. second elongated current carrying means disposed in another of said spaced mounting guides also having a portion thereof extending through another of said aligned slot means to form a second terminal means aligned with and parallel to said first terminal means,
f. first contact means in said element chamber fixedly connected to said first elongated current carrying means,
g. bimetallic actuating means in said element chamber connected to said second elongated current carrying means having, a bimetallic element disposed in alignment with the second elongated current carrying means,
h. second contact means on said bimetallic element movable for engagement and disengagement with the first contact means as a function of the operation of said bimetallic element, carrying means,
i. said first elongated current carrying means, said second elongated current carrying means, and said bimetallic actuator so mounted, assembled and nested in the housing that the bimetallic element is free for substantial amplitude of movement to permit operation of the circuit breaker in the cycling mode,
j. a centrally disposed ridge on the element chamber side of the back wall, a coating ridge on one of the side walls, and means on the other side wall, define the spaced mounting guides on the element chamber side of the back wall,
k. the spaced slot means are each respectively of a lesser width than the width of the associated mounting guides,
l. spaced stop means formed on the end wall adjacent each of said spaced slot means,
m. said first elongated current carrying means having a first shoulder means disposed to engage one of said stop means in assembled position,
n. said second elongated current carrying means having a second shoulder means disposed to engage another of said stop means in assembled position,
o. said bimetallic element including, an annular base means connected to the second elongated current carrying means, and a bimetallic member connected at one end to the annular base means so that the free end is in the longitudinal line of the second elongated current carrying means and can move responsive to changes in temperature,
p. said second contact means connected to and movable with the free end of said bimetallic member,
q. bracket means connected to said first elongated current carrying means having a portion thereof disposed to overlie the second contact means, and
r. said first contact means fixedly connected to the side of the bracket means for operative association with the second contact means.

8. A miniature circuit breaker comprising,
a. sized housing means having, wall means including, a back wall, a front wall, spaced side walls therebetween, and an end wall defining an element chamber,
b. spaced mounting guides on the element chamber surface of the back wall disposed parallel to the longitudinal line of the housing,
c. spaced slot means in the end wall respectively disposed in alignment with an associated one of said spaced mounting guides,
d. first elongated current carrying means disposed in one of said spaced mounting guides and having a portion thereof extending through one of the aligned slot means to form a first terminal means,
e. second elongated current carrying means disposed in another of said spaced mounting guides also having a portion thereof extending through another of said aligned slot means to form a second terminal means aligned with and parallel to said first terminal means,
f. first contact means in said element chamber fixedly connected to aid first elongated current carrying means,
g. bimetallic actuating means in said element chamber connected to said second elongated current carrying means having, a bimetallic element disposed in alignment with the second elongated current carrying means,
h. second contact means on said bimetallic element movable for engagement and disengagement with the first contact means as a function of the operation of said bimetallic element,
i. said first elongated current carrying means, said second elongated current carrying means, and said bimetallic actuator so mounted, assembled and nested in the housing that the bimetallic element is free for substantial amplitude of movement, and
j. an insulating and manual reset assembly slidably mounted in the housing for operative association with the fixed contact and movable contact including, actuating means to permit operation of the miniature circuit breaker in the non-cycling mode.

9. In a miniature circuit breaker as claimed in claim 8 wherein,
a. said insulating and manual reset assembly includes, an insulating and manual reset member mounted in said housing in a position offset from the first elongated current carrying means and second elongated current carrying means,
b. said insulating and manual reset means including, a laterally extending member normally disposed out of engagement with said first contact means and second contact means when they are in the closed position, and
c. means for actuating said insulating and manual reset member to move into engagement between the first contact means and second contact means when they are moved to open position.

10. In a miniature circuit breaker as claimed in claim 8 wherein, a. said insulating and manual reset assembly includes, an insulating and manual reset member mounted in said housing in a position offset from the first elongated current carrying means and second elongated current carrying means, b. said insulating and manual reset means having, a laterally extending member normally disposed out of engagement with said first contact means and second contact means when they are in the closed position, c. means for actuating said insulating and manual reset member to move into engagement between the first contact means and second contact means when they are moved to open position, and d. visual signal means on said insulating and manual reset member disposed on movement thereof to extend to the exterior of the housing means and to provide means for manually resetting the insulating and manual reset member during operation of the circuit breaker.

11. In a miniature circuit breaker as claimed in claim 8 wherein, a centrally disposed ridge on the element chamber side of the back wall, a coacting ridge on one of the side walls, and means on the other side wall, define the spaced mounting guides on the element chamber surface side of the back wall.

12. In a miniature circuit breaker as claimed in claim 8 wherein, a. the spaced slot means are each respectively of a lesser width than the width of the associated mounting guides, b. spaced stop means formed on the end wall adjacent each of said spaced slot means, c. said first elongated current carrying means having a first shoulder means disposed to engage one of said stop means in assembled position, and d. said second elongated current carrying means having a second shoulder means disposed to engage another of said stop means in assembled position.

13. A miniature circuit breaker comprising, a. sized housing means having, wall means including, a back wall, a front wall, spaced side walls therebetween, and an end wall defining an element chamber, b. spaced mounting guides on the element chamber surface of the back wall disposed parallel to the longitudinal line of the housing, c. spaced slot means in the end wall respectively disposed in alignment with an associated one of said spaced mounting guides, d. first elongated current carrying means disposed in one of said spaced mounting of said spaced mounting guides and having a portion thereof extending through one of the aligned slot means to form a first terminal means, e. second elongated current carrying means disposed in another of said spaced mounting guides also having a portion thereof extending through another of said aligned slot means to form a second terminal means aligned with and parallel to said first terminal means, f. First contact means in said element chamber fixedly connected to aid first elongated current carrying means, g. bimetallic actuating means in said element chamber connected to said second elongated current carrying means having, a bimetallic element disposed in alignment with the second elongated current carrying means, h. second contact means on said bimetallic element movable for engagement and disengagement with the first contact means as a function of the operation of said bimetallic element, i. said first elongated current carrying means, said second elongated current carrying means, and said bimetallic actuator so mounted, assembled and nested in the housing that the bimetallic element is free for substantial amplitude of movement, j. an insulating and manual reset assembly slidably mounted in the housing for operative association with the fixed contact and movable contact including, actuating means to permit operation of the miniature circuit breaker in the non-cycling mode, k. said bimetallic element including, an annular base means connected to the second elongated current carrying means and a bimetallic member connected at one end to the annular base means so that the free end is in the longitudinal line of the second elongated current carrying means and can move responsive to changes in temperature, l. said second contact means connected to and movable with the free end of said bimetallic member, m. bracket means connected to said first elongated current carrying means having a portion thereof disposed to overlie the second contact means, and n. said first contact means fixedly connected to the side of the bracket means for operative association with the second contact means.

14. In a miniature circuit breaker as claimed in claim 8 wherein, a. a centrally disposed ridge on the element chamber side of the back wall, a coacting ridge on one of the side walls, and means on the other side wall, define the spaced mounting guides on the element chamber surface side of the back wall, b. the spaced slot means are each respectively of a lesser width than the width of the associated mounting guides, c. spaced stop means formed on the end wall adjacent each of said spaced slot means, d. said first elongated current carrying means having a first shoulder means disposed to engage one of said stop means in assembled position, and e. said second elongated current carrying means having a second shoulder means disposed to engage another of said stop means in assembled position.

15. In a miniature circuit breaker as claimed in claim 13 wherein a centrally disposed ridge on the element chamber side of the back wall, a coacting ridge on one of the side walls, and means on the other side wall, define the spaced mounting guides on the element chamber surface side of the back wall.

16. In a miniature circuit breaker as claimed in claim 15 wherein, a. the spaced slot means are each respectively of a lesser width than the width of the associated mounting guides, b. spaced stop means are formed on the end wall adjacent each of said spaced slot means, c. said first elongated current carrying means having a first shoulder means disposed to engage one of said stop means in assembled position, and d. said second elongated current carrying means having a second shoulder means disposed to engage another of said stop means in assembled position.

17. A miniature circuit breaker with manual reset comprising, a. sized housing means defining an element chamber, b. an elongated sized and shaped first terminal means and an elongated sized and shaped second terminal means mounted in predetermined spaced relation in said housing, and each of said first terminal means and second terminal means having a portion thereof disposed to extend to the exterior of the housing so they lie parallel to and in alignment with each other, c. a first contact means connected to the portion of said first terminal means in the housing, d. precision type bimetallic actuator means connected to the portion of said second terminal means in the housing and having a bimetallic operating element with, a second contact on the free thereof normally in engagement with the first contact means and movable on operation of the bimetallic operating element to disengage from the first contact, e. means defining an insulating and manual reset assembly in the housing laterally of the first terminal means and second terminal means, f. said insulating and manual reset assembly including, an insulating and manual reset member slidably mounted in said housing and having a transverse leg disposed for movement in a plane between said first contact means and second contact means when they are in the disengaged position, g. resilient means operable to move the insulating manual and reset member between said first contact means and second contact means when they move to the disengaged position, and h. visual signal means on said insulating and manual reset member disposed on movement thereof to extend to the exterior of the housing means and to provide means for manually resetting the insulating and manual reset member during operation of the circuit breaker.

18. A miniature circuit breaker with manual reset comprising, a. sized housing means defining an element chamber, b. an elongated sized and shaped first terminal means and an elongated sized and shaped second terminal means mounted in predetermined spaced relation in said housing, and each of said first terminal means and second terminal means having a portion thereof disposed to extend to the exterior of the housing so they lie parallel to and in alignment with each other, c. a first contact means connected to the portion of said first terminal means in the housing, d. precision type bimetallic actuator means connected to the portion of said second terminal means in the housing and having a bimetallic operating element with, a second contact means on the free end thereof normally in engagement with the first contact means and movable on operation of the bimetallic operating element to disengage from the first contact, e. means defining an insulating and manual reset assembly in the housing laterally of the first terminal means and second terminal means, f. said insulating and manual reset assembly including, an insulating and manual reset member slidably mounted in said housing and having a transverse leg disposed for movement in a plane between said first contact means and second contact means when they are in the disengaged position, g. resilient means operable to move the insulating and manual reset member between said first contact means and second contact means when they move to the disengaged position, h. visual signal means on said insulating and manual rest member disposed on movement thereof to extend to the exterior of the housing means and to provide means for manually resetting the insulating and manual reset member during operation of the circuit breaker, i. the means defining the insulating and manual reset assembly including, a thickened wall section offset from and disposed to overlie one of said first and second terminal means, j. a bore formed in said thickened wall section generally in alignment with the first and second terminal means, k. slot means extending through the bore the length of said thickened wall section, l. said insulating and manual reset member mounted for sliding movement in said slot means, and m. said resilient means for actuating said insulating and manual reset member disposed in the bore in a normally compressed condition and operative to move the insulating and manual reset member when the movable contact and fixed contact move to an open position.

19. A miniature circuit breaker with manual reset comprising, a. sized housing means defining an element chamber, b. an elongated sized and shaped first terminal means and an elongated sized and shaped second terminal means mounted in predetermined spaced relation in said housing, and each of said first terminal means and second terminal means having a portion thereof disposed to extend to the exterior of the housing so they lie parallel to and in alignment with each other, c. a first contact means connected to the portion of said first terminal means in the housing, d. precision type bimetallic actuator means connected to the portion of said second terminal means in the housing and having a bimetallic operating element with, a second contact means on the free end thereof normally in engagement with the first contact means and movable on operation of the bimetallic operating element to disengage from the first contact, e. means defining an insulating and manual reset assembly in the housing laterally of the first terminal means and second terminal means, f. said insulating and manual reset assembly including, an insulating and manual reset member slidably mounted in said housing and having a transverse leg disposed for movement in a plane between said first contact means and second contact means when they are in the disengaged position, g. resilient means operable to move the insulating and manual reset member between said first contact means and second contact means when they move to the disengaged position, h. visual signal means on said insulating and manual reset member disposed on movement thereof to extend to the exterior of the housing means and to provide means for manually resetting the insulating and manual reset member during operation of the circuit breaker, i. said bimetallic element including, an annular base means connected to the second terminal means, and a bimetallic member connected at one end to the annular base means so that the free end is in the longitudinal line of the second terminal means and can move responsive to changes in temperature, j. said second contact means connected to and movable with the free end of said bimetallic member, k. bracket means connected to said first terminal means having a portion thereof disposed to overlie the second contact means, and l. said first contact means fixedly connected to the side of the bracket means for operative association with the second contact means.

* * * * *

UNITED STATES PATENT AND TRADEMARK OFFICE

CERTIFICATE OF CORRECTION

PATENT NO. : 4,803,455

DATED : February 7, 1989

INVENTOR(S) : Robert A. Kuczynski

It is certified that error appears in the above-identified patent and that said Letters Patent is hereby corrected as shown below:

Column 4, line 28, delete "in place of a conventional fuse of the".
Column 7, line 25, "gu" should read --guide--.
Column 7, line 36, after "characteristic" insert --of--.
Column 7, line 37, after "actuator" insert --30--.
Column 7, line 48, "t" should read --the--.
Column 10, line 50, after "and" insert --36--.
Column 10, line 50, after "leg" insert --48--.
Column 12, line 23, after "the" insert --second elongated current--.
Column 12, line 49, after "said" insert --first elongated current--.
Column 13, line 41, delete "carrying means,".
Column 15, line 56, delete "of said spaced mounting".
Column 17, line 23,after "contact" insert --means--.
Column 17, line 23, after "free" insert --end--.
Column 17, line 38, "manual and" should read --and manual--.

Signed and Sealed this

Twenty-fifth Day of July, 1989

*Attest:*

*Attesting Officer*

DONALD J. QUIGG

*Commissioner of Patents and Trademarks*